US006357492B1

(12) United States Patent
Hsu

(10) Patent No.: US 6,357,492 B1
(45) Date of Patent: Mar. 19, 2002

(54) LIQUID CHANGER

(76) Inventor: Sgr-Bin Hsu, P.O. Box 90, Tainan City (TW)

( * ) Notice: Subject to any disclaimer, the term of this patent is extended or adjusted under 35 U.S.C. 154(b) by 0 days.

(21) Appl. No.: 09/875,189

(22) Filed: Jun. 7, 2001

(51) Int. Cl.[7] ..... B65B 1/04; B65B 3/04; B65B 31/00; B67C 3/00

(52) U.S. Cl. ..... 141/26; 141/21; 141/25; 141/41; 141/44; 141/309; 137/565.25; 184/28

(58) Field of Search ..... 141/18, 21, 25, 141/26, 37, 39, 41, 44, 285, 309; 137/565.01, 565.25; 184/1.5, 28

(56) References Cited

U.S. PATENT DOCUMENTS 1,439,295 A * 12/1922 Craig ..... 141/26
5,203,677 A * 4/1993 Lix et al. ..... 137/565.3
5,450,924 A * 9/1995 Tseng ..... 137/202

* cited by examiner

*Primary Examiner*—Timothy L. Maust

(57) ABSTRACT

A liquid changer includes a base, a liquid tank, a pump and a changeover valve. The base has two insert grooves for the liquid tank and the pump to fit therein to stand up. The changeover valve is located at one side of the pump. Switching the changeover valve to IN or OUT position can pump out the liquid in the liquid tank or exhaust out the liquid in a container of any other use. Thus the liquid changer can be used in two ways by means of the changeover valve easily switched. In addition, the pump is located outside the liquid tank, increasing liquid volume to be stored in the liquid tank.

5 Claims, 4 Drawing Sheets

LIQUID CHANGER

BACKGROUND OF THE INVENTION

1. Field of the Invention

This invention relates to a liquid changer, particularly to one provided with a changeover valve so that the liquid changer can not only store liquid therein but also pump out the liquid therein in another container with a pump attached outside of the liquid changer so as to increase liquid volume stored and to change liquid to be stored therein.

In case that oil in an engine, a transmission case, pressure oil, water in a water tank, lubricating oil, brake oil, industrial solvent or any waste water is to be exhausted to replace with new one, it is done almost manually by a technician and results in a technical expenditure. But now a liquid changer has been used instead of manual work.

2. Description of the Prior Art

A known conventional liquid changer shown in FIG. 1 includes a cover 10, a base 11, a liquid tank 12 for storing liquid and a pump tank 13 for storing pressured air provided orderly between the cover and the base 11, a pressing rod 14 deposited in the pump tank 13 and having an upper end protruding out of the cover 10 for locking a handle 140. The lower end of the pressing rod 14 is fixed with a one-way valve 141 and the base 11 has a hole 110 in the center, and a one-way valve 111 is fixed on the hole 110 so that the air in the pump tank 13 may be pumped out through the hole 110. The cover 10 has a one-way inlet 100 connected to the top end of the liquid tank 12, and an oil inlet 101 bored in a sidewall of the top end, and an oil sucking tube 15 fixed on the oil inlet 101 and possible to extend in the an engine oil chamber. Then the pump tank 13 can exhaust out the air in the liquid tank 12 for easy change of engine oil. But this conventional engine oil-sucking device can only suck out engine oil from the engine oil chamber, impossible to pump in new engine oil in the same chamber. That results in much time and work in changing engine oil. Besides, the pump tank 13 is located in the liquid tank 13, only storing a small amount of oil.

SUMMARY OF THE INVENTION

The objective of the invention to offer a liquid changer possible to store and use the liquid stored therein and change old liquid stored to new one easily.

The feature of the invention is a base, a liquid storing tank fixed on the base and closed with an upper cap, a pump also fixed on the base beside the liquid tank for pumping liquid in and out of the liquid tank, a changeover valve fixed at one side of the pump for.

Switching to pump in or pumping out liquid. The upper cap has a liquid inlet and outlet and a gas inlet and outlet, a guide tube fixed on the liquid inlet and outlet, and another guide tube fixed on the gas inlet and outlet. One more guide tube is fixed inside the liquid inlet and outlet, extending down in the liquid tank. The pump has a pump tank, and a press rod provided to extend in the pump tank and connected with a press grip, which has a bottom end fixed with a piston. The pump tank further has an outlet respectively formed in an upper end and a lower end, and connected respectively with a guide tube. The changeover valve has an air hole in a sidewall and connected to the gas guide tube of the liquid tank and an outlet in an upper end of the sidewall and an inlet in a lower end of the sidewall. The outlet of the changeover valve is then connected to the upper outlet of the pump and the inlet of the changeover valve is then connected to the lower outlet.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
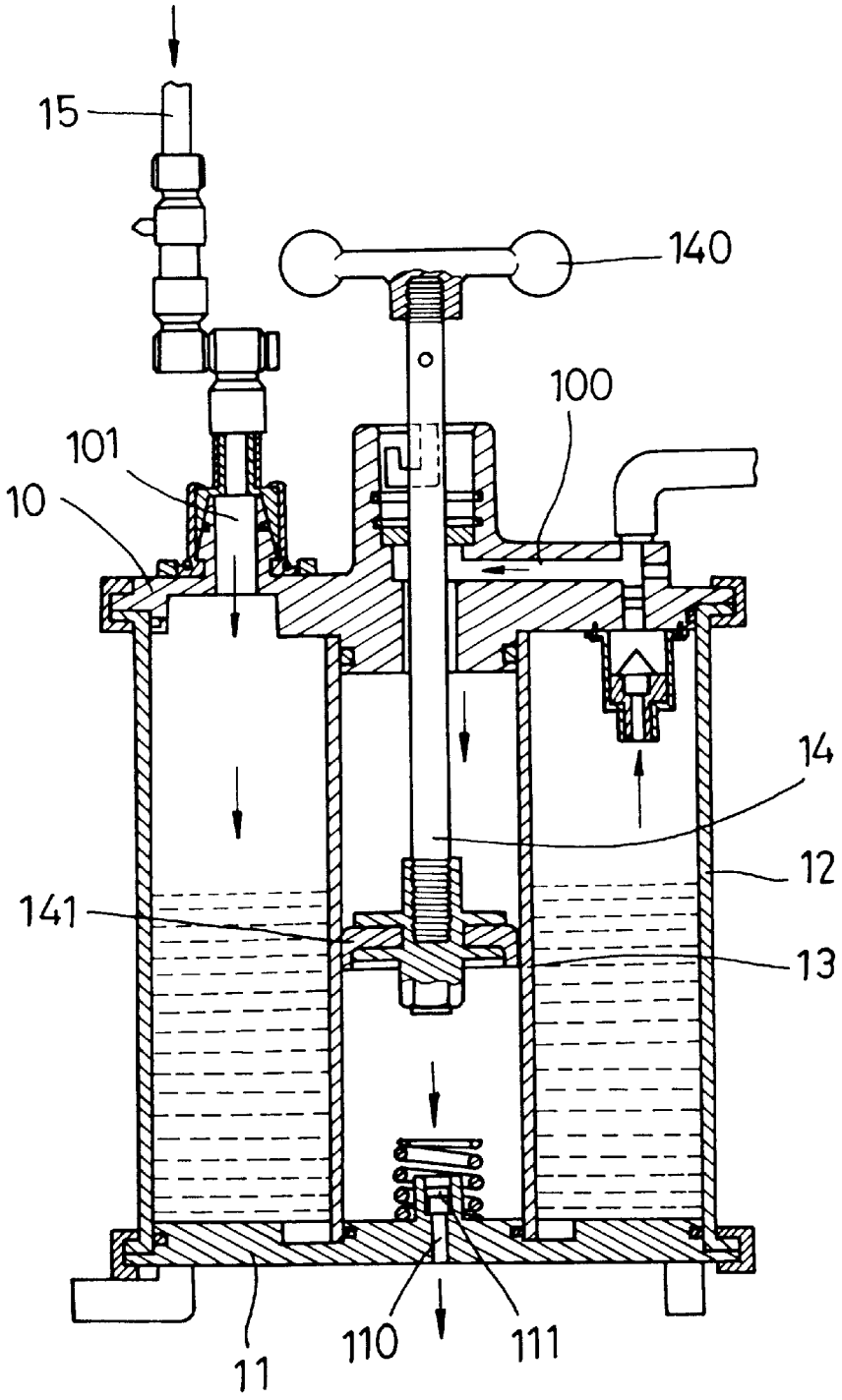
FIG. 1 (PRIOR ART)
FIG. 1 is a cross-sectional view of a known conventional liquid changer.
Figure 2:
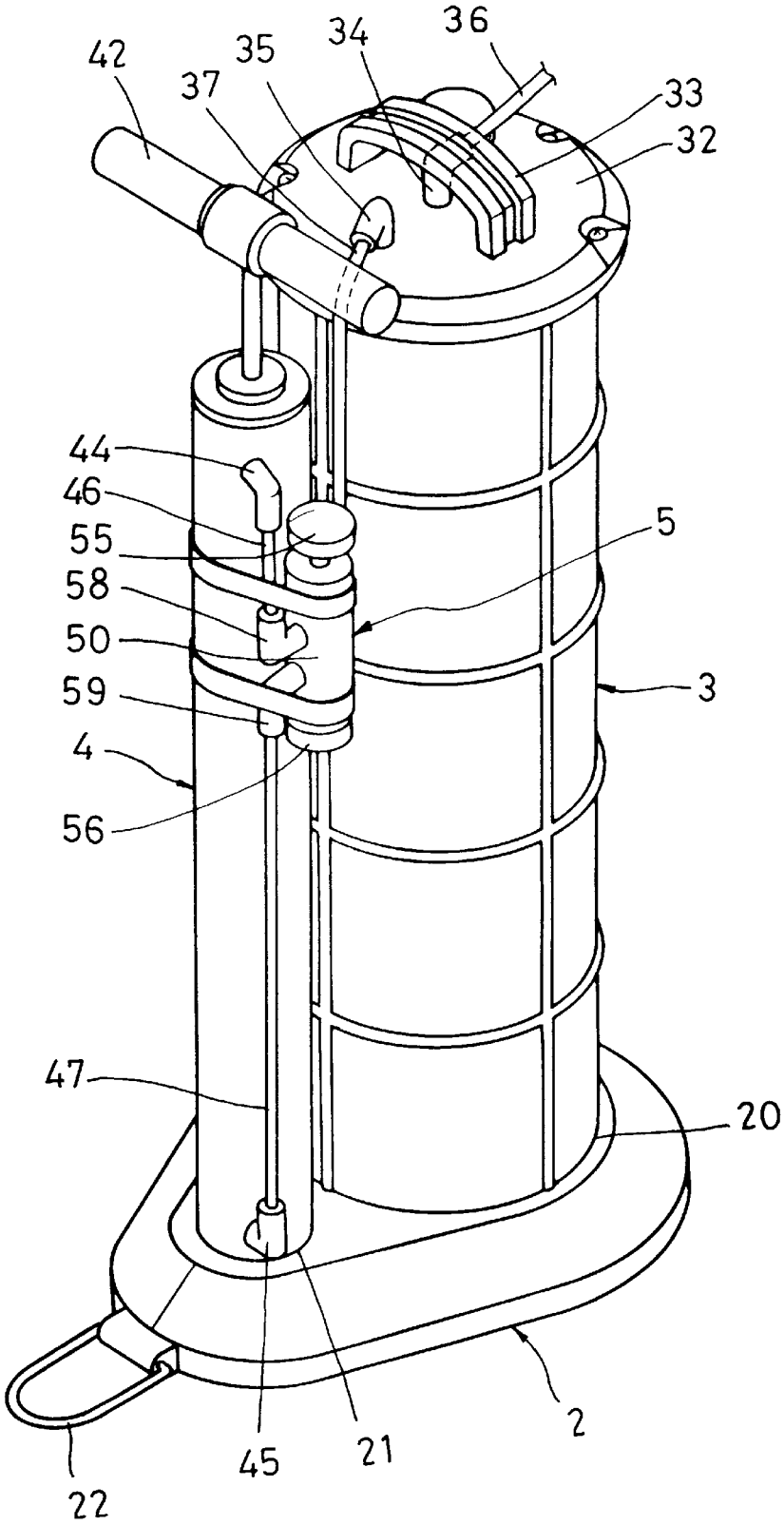
FIG. 2 is a perspective view of a liquid changer in the present invention.
Figure 3:
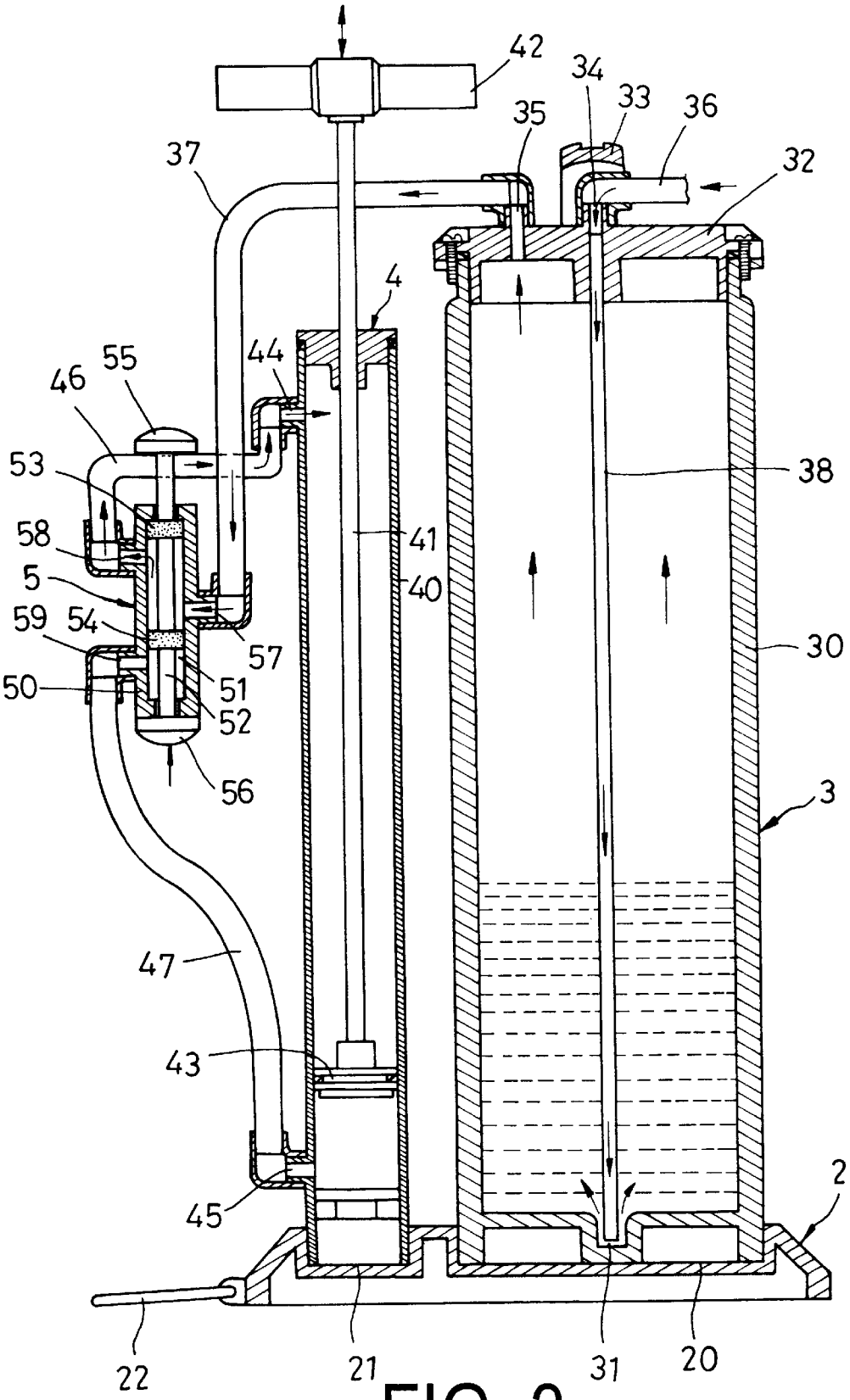
FIG. 3 is a side cross-sectional view of the liquid changer in pumping-out liquid condition in the present invention; and, FIG. 4 is a side cross-sectional view of the liquid changer in exhausting liquid condition in the present invention.

A preferred embodiment of a liquid changer in the present invention, as shown in FIGS. 2 and 3, includes a base 2, a liquid tank 3, a pump 4 and a changeover valve 5 as main components combined together.

The base 2 has two insert grooves 20, 21 formed in an upper surface, and a step ring 22 moveably attached with a left side.

The liquid tank 3 is fixed in the first insert groove 20 of the base 2 to stand up, having a tank body 30, a recess 31 in the center of the bottom, a cap 32 closing the upper open end, a handle 33 fixed on the cap 32, a liquid inlet and outlet 34 and a gas inlet and outlet 35 formed on the cap 32, a first guide tube 36 connected to the liquid inlet and outlet 34, and a second guide tube 37 connected to the gas inlet and outlet 35. An inner guide tube 38 is provided inside the liquid tank 3, with its upper end connected with the liquid inlet and outlet 34 and with its lower end fitting in the recess 31 of the bottom of the liquid tank body 30 with a gap formed between the lower end of the guide tube 38 and the bottom of the recess 31.

The pump 4 is fixed in the second insert groove 21 of the base 2 to stand up, having a pump tank 40, an elongate press rod 41 extending movably in the pump tank 40 and having an upper end protruding out of the upper end of the pump tank 40 and combined with a press handle 42. The press rod 41 has its lower end fixed with a piston 43 to move up and down with the press rod 41 in the pump tank 40, which has a gas outlet 44 in an upper wall and another gas outlet 45 in a lower wall, and a guide tube 46 and 47 respectively connected to the two outlets 44, 45.

The changeover valve 5 is located at one side of the pump 4, having a tubular member 50 formed with a center passageway 51, a rod 52 inserted in the passageway 51, the rod 52 having two stoppers 53, 54 fixed on an upper portion and a lower portion in the tubular member 50 and two ends respectively protruding out of an upper end and a lower end of the tubular member 50 and respectively connected to a press button 55 and 56. Further the tubular member 50 has a guide hole 57 in an intermediate wall communicating with the passageway 51 and connected to the second gas guide tube 37 of the liquid tank 3, an outlet 58 bored in an upper wall and an inlet 59 bored in a lower wall. The outlet 58 is connected with the upper outlet 44 of the pump 4 and the inlet 59 is connected to the lower outlet 45 of the pump 4.

When new liquid is to be pumped in the liquid tank 3 for changing old engine oil or pumping out the liquid stored in the storing tank 3, insert the first guide tube 36 in a container (such as a fuel tank), and switch the changeover valve 5 to an OUT position shown in FIG. 3, letting the stopper 54 in the tubular member 50 block the course between the inlet 59 and the guide hole 57 to close up the inlet 59. Then the outlet 58 is open, so a user only repeatedly moves up and down the press handle 42 to suck in liquid. When the press handle 42 moves down the piston 43, gas is sucked in, and the gas in the liquid tank 3 is also sucked out through the gas inlet and outlet 35 through the second guide tube via the guide hole 57 of the changeover valve 5 into the passageway 51 of the tubular member 50, and then is exhausted out of the outlet 58 through the guide tube 46 into the outlet 44 and into the pump 4. Thus, the liquid tank 3 becomes vacuum, so the liquid in a container can flow through the first guide tube 36 and the inlet and outlet 34 into the guide tube 38 and finally into the liquid tank 3 for storing. Continual pumping of the pump 4 can suck all the liquid in the container wholly in the liquid tank 3, replacing with new liquid like engine oil, very convenient and quick.

Figure 4:
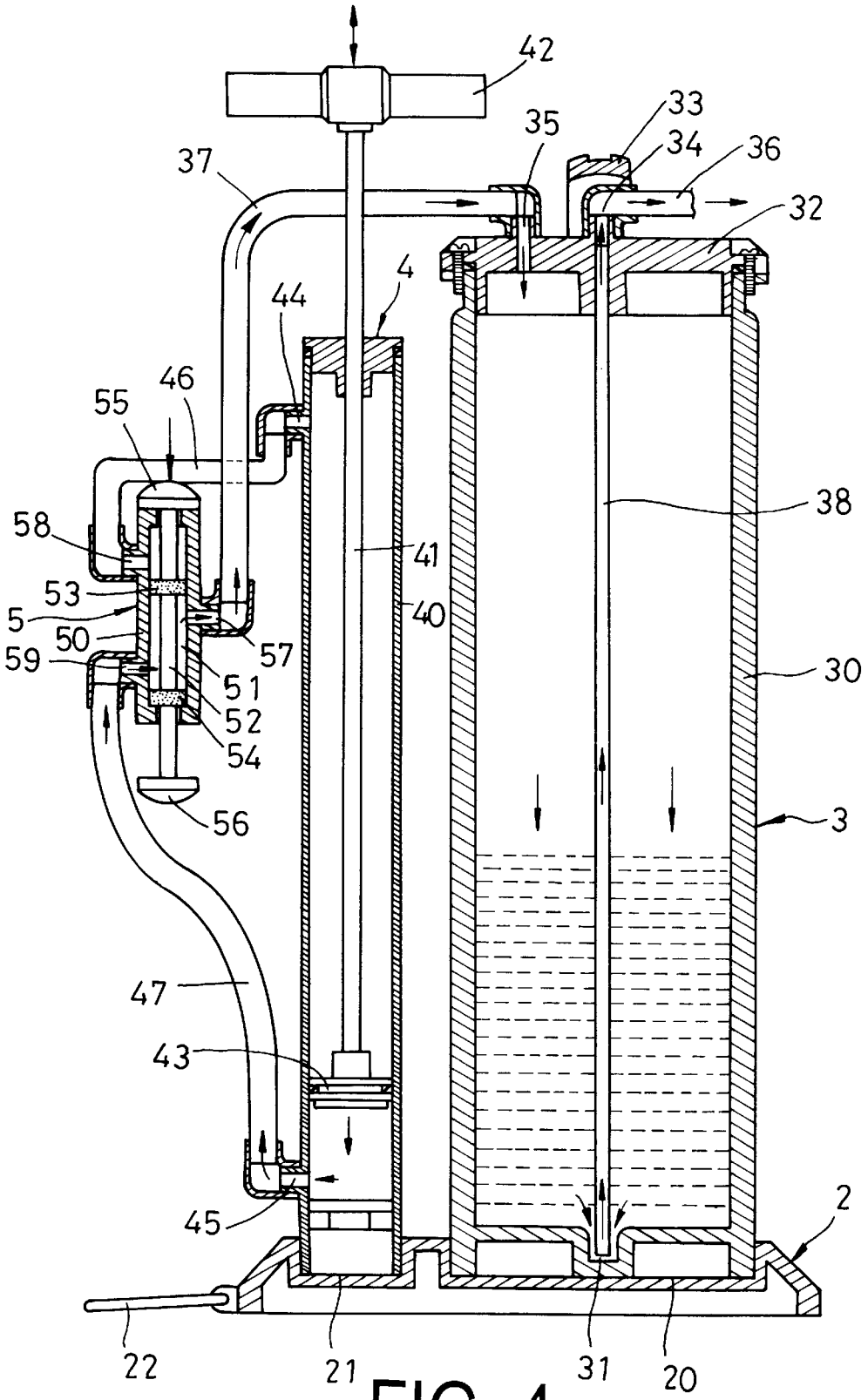

In addition, the liquid changer can not only pump out the liquid stored in the liquid tank 3 but also exhaust out the liquid stored in the liquid tank 3. In exhausting out the liquid in the liquid tank 3, the press button 55 of the changeover valve 5 is needed to switch to IN position as shown in FIG. 4, letting the stopper 58 in the tubular member 50 block the course between the outlet 58 and the guide hole 57 to close up the outlet 58. Then the inlet 59 becomes open, and pressing up and down the press handle 42 of the pump 4 can exhaust out the liquid in the liquid tank 3 by the piston 43 moved down to press air to flow out of the outlet 45 of the pump 4 into the guide tube 47 and then into the passageway 51 of the tubular member through the inlet 59 of the changeover valve 5 and the guide hole 57 via the second guide tube 37 into the liquid tank 3. Therefore, continual air flowing in the liquid tank 3 can compress the liquid move down through the liquid guide tube 38 upward and out of the liquid inlet and outlet 34 into the first guide tube 36 and then into a container for receiving the liquid. Thus, exhausting out of the liquid in the liquid tank 3 is very convenient and fast.

Further, provision of the recess 31 in the bottom of the liquid tank 3 enable the liquid stored in the liquid tank completely pumped out, not a bit of it remaining therein. And the liquid changer has two functions of pumping out and exhausting out the liquid in the liquid tank 3, permitting a consumer save some money without need of buying two kinds of liquid changers, one for pumping out and another for exhausting out, by switching the changeover valve with fastness.

While the preferred embodiment of the invention has been described above, it will be recognized and understood that various modifications may be made therein and the appended claims are intended to cover all such modifications that may fall within the spirit and scope of the invention.

What is claimed is:

1. A liquid changer comprising:

a base having two insert grooves formed in an upper surface;

a liquid tank fixed in one of said two insert grooves to stand up, having a cover closing on an upper open end, said cover having a liquid inlet and outlet and a gas inlet and outlet, a first guide tube fixed on said liquid inlet and outlet, a second guide tube fixed on said gas inlet and outlet, an inner guide tube located in said liquid tank and having an upper end connected to an inner side of said liquid inlet and outlet;

a pump fixed in the other of said two insert grooves to stand up, having a pump tank, an elongate press rod extending in said pump tank and having an upper end protruding up out of an upper end of said pump tank, a piston fixed with a lower end of said press rod, an upper outlet formed in an upper wall and a lower outlet formed in a lower wall, said upper outlet and said lower outlet respectively connected to a guide tube;

a changeover valve located at one side of said pump, having a tubular member provided with a guide hole in an intermediate wall, said guide hole connected to said second gas guide tube, said tubular member further having an outlet formed in an upper wall and an inlet formed in a lower wall, said outlet connected to said upper outlet of said pump, said inlet connected to said lower outlet of said pump; and, said changeover valve switched to IN or OUT position for either pumping out the liquid stored in said liquid tank or exhausting out the liquid into a container of any other use, said liquid changer having two functions by means of said changeover valve, said pump located outside of said liquid tank so as to increase storing volume of said liquid tank, conveniently and quickly replacing old liquid stored in said liquid tank with new liquid.

2. The liquid changer as claimed in claim 1, wherein said base has a step ring fixed at one side.

3. The liquid changer as claimed in claim 1, wherein said liquid tank has a recess formed in a bottom for a lower end of said inner guide tube in said liquid tank to fit therein with a gap formed between said lower end of said inner guide tube and a bottom of said recess for liquid stored in said liquid tank to be pumped out completely.

4. The liquid changer as claimed in claim 1, wherein said tubular member of said changeover valve has an inner passageway, a rod extending in said passageway and having two stoppers fixed around said rod, one of said two stoppers located at an upper portion and the other located at a lower portion of said rod, said rod having two ends protruding out of said tubular member and then fixed with a press button, a guide hole formed in an intermediate wall of said tubular member and communicating with said inner passageway, and an outlet formed in an upper wall and an inlet formed in a lower wall of said tubular tube also communicating with said inner passageway.

5. The liquid changer as claimed in claim 1, wherein said cover of said liquid tank has a handle fixed on an upper surface.

* * * * *